US009168575B2

(12) United States Patent
Kenjale et al.

(10) Patent No.: US 9,168,575 B2
(45) Date of Patent: Oct. 27, 2015

(54) NO-SLIT HOT ROLLING OF RAILROAD RAILS

(71) Applicant: W. Silver Inc., Vinton, TX (US)

(72) Inventors: Bhupendra Kenjale, El Paso, TX (US); Alfredo Cardona, El Paso, TX (US); Kishan Raghunath, El Paso, TX (US); Luis Garcia, El Paso, TX (US); Mark Fenenbock, El Paso, TX (US)

(73) Assignee: W. Silver Inc., Vinton, TX (US)

( * ) Notice: Subject to any disclaimer, the term of this patent is extended or adjusted under 35 U.S.C. 154(b) by 0 days.

(21) Appl. No.: 14/686,543

(22) Filed: Apr. 14, 2015

(65) Prior Publication Data

US 2015/0217348 A1 Aug. 6, 2015

Related U.S. Application Data

(63) Continuation-in-part of application No. 13/247,389, filed on Sep. 28, 2011.

(51) Int. Cl.
*B21B 1/085* (2006.01)

(52) U.S. Cl.
CPC ..... *B21B 1/0855* (2013.01)

(58) Field of Classification Search
CPC ..... B21B 1/085; B21B 1/0855; B21B 15/00; B21B 2015/0021; B21B 2015/0071
USPC ..... 72/200, 204, 223, 130, 366.2, 234
See application file for complete search history.

(56) References Cited

U.S. PATENT DOCUMENTS

| | | | |
|---|---|---|---|
| 185,316 | A | 12/1876 | Garrett |
| 219,616 | A | 9/1879 | Brunner |
| 219,722 | A | 9/1879 | Hayden et al. |
| 220,240 | A | 10/1879 | Hewitt |
| 226,982 | A | 4/1880 | Davis |
| 227,010 | A | 4/1880 | Holub et al. |
| 242,534 | A | 6/1881 | Holub et al. |
| 249,742 | A | 11/1881 | Buchingham |
| 294,757 | A | 3/1884 | Brown |
| 305,808 | A | 9/1884 | Greer |
| 305,809 | A | 9/1884 | Greer |
| 328,937 | A | 10/1885 | Hargreaves |
| 335,879 | A | 2/1886 | Beach |
| 371,359 | A | 10/1887 | Reese |
| 451,002 | A | 4/1891 | Harris |
| 532,424 | A | 1/1895 | Maus |
| 664,001 | A | 12/1900 | Nisbett et al. |
| 722,152 | A | 3/1903 | Sellers |
| 807,650 | A | 12/1905 | York |

(Continued)

*Primary Examiner* — A. Dexter Tugbang
*Assistant Examiner* — Joshua D Anderson
(74) *Attorney, Agent, or Firm* — Greer Burns & Crain, Ltd.

(57) ABSTRACT

A method of recycling a one-piece rail having a base portion and a head portion spaced from each other by a substantially flat web portion. The steps include: heating the rail to a plastic state; feeding the heated rail through a first reduction pass to reduce a cross section of the rail without slitting the rail; feeding the bar through a second reduction pass in which the cross section of the bar is further modified; feeding the bar through a third reduction pass in which the cross section of the bar is further modified and then slitting the bar along the web portion into two bar pieces, one containing the former head portion and one containing the former base portion, as the bar leaves the third reduction pass; and rolling the two bar pieces through a series of reduction passes to produce a desired final cross section of the pieces.

19 Claims, 6 Drawing Sheets

(56) References Cited

U.S. PATENT DOCUMENTS

| | | | |
|---|---|---|---|
| 852,983 | A | 5/1907 | Slick |
| 885,508 | A | 4/1908 | McKee |
| 1,086,789 | A | 2/1914 | Slick |
| 1,206,606 | A | 11/1916 | Slick |
| 1,883,338 | A | 10/1932 | Connors |
| 1,910,271 | A | 5/1933 | Williams |
| 2,040,494 | A | 5/1936 | Miller |
| 4,268,948 | A | 5/1981 | Strandell et al. |
| 4,357,819 | A | 11/1982 | Elley |
| 4,779,439 | A | 10/1988 | Baldi |
| 4,982,591 | A | 1/1991 | McGahhey |
| 5,526,667 | A | 6/1996 | Baldi et al. |
| 5,548,986 | A | 8/1996 | Matsuo et al. |
| 7,073,238 | B1 | 7/2006 | Moore et al. |
| 7,996,973 | B2 | 8/2011 | Moore et al. |

NO-SLIT HOT ROLLING OF RAILROAD RAILS

This application is a Continuation-In-Part (CIP) Application of U.S. Ser. No. 13/247,389, filed Sep. 28, 2011, the entire contents of which are hereby incorporated by reference.

BACKGROUND OF THE INVENTION

The present invention relates to a process of recycling worn railroad rails.

There are known processes for recycling worn railroad rails which involve heating the rail within a furnace to a plastic state for molding thereof by means of rolling operations. Often, such rolling operations are associated with separate processing of cut portions of the rail, such as its head, web and base. In some instances, all portions of the worn rail are processed along one shaping line into bar products, such as fence posts or rebars.

The recycling of worn rails without cutting thereof has been proposed, as disclosed for example in U.S. Pat. Nos. 328,937, 852,983, 1,086,789 and 1,206,606. Such prior known methods of recycling worn rails have never proved successful in producing a one-piece billet or slab, because of problems created by the formation of laps, seams and folds during the rolling operations, giving rise to quality defects in the product produced. It is also known from U.S. Pat. No. 4,982,591 to heat a worn, one-piece rail to a plastic state which is initially deformed by a multi-stage rolling action to a slab constituted by flattened base and head extensions of an un-deformed web portion of the rail. The slab is then edged in stages to effect thickening of its intermediate portion and formation of a billet without any lapping, seaming or folding.

Further, it is known from U.S. Pat. Nos. 7,073,238 and 7,996,973 to heat the rail and slit it into two pieces in a first reduction pass and then subsequently pass the two pieces through a single mill pass line such that each piece of the rail is deformed to have a generally uniform shape. In the event that the rail has a through hole in a web portion of the rail, the slit preferably occurs through the area of the hole.

A problem encountered with the processing of rails, particularly where the rails are slit into separate pieces, is that the size and configuration of the head portion of the rails may vary greatly from rail to rail due to different wearing history of the bearing surface of the rail. Depending on when the rail was replaced, traffic conditions during rail usage, weather and orientation of the rail, the size and shape of the head portion may vary greatly from its initial size and shape. When the rail is slit into pieces before it is reshaped to any degree, the variations in the head size will be maintained as variations in the size of the pieces, making it difficult to process the rail pieces in a single line pass operation and to achieve substantially identical final end piece sizes.

A solution to this problem would be an improvement in the art.

SUMMARY OF THE INVENTION

In an embodiment, the present invention provides a method of recycling a one-piece rail having a base portion and a head portion spaced from each other along an axis by a substantially flat web portion. The method includes a step of heating the material of the rail to a plastic state. Another step includes feeding the heated rail through a first reduction pass to form a bar having a former head portion, a web portion and an former base portion in which a starting cross section of the rail is reduced in at least one dimension without slitting the rail. For this reason, the method of the present invention is referred to as "no-slit" since it leaves the first reduction pass without being slit. Another step includes feeding the bar through a second reduction pass in which the cross section of the bar is further modified.

The method proceeds with the step of slitting the bar along the web portion into two bar pieces, one piece containing the head portion and one piece containing the base portion, as the bar leaves the second reduction pass. Another step includes rolling the two pieces of the bar, in a single pass line, through a series of reduction passes to produce a desired final cross section of the bar pieces.

In an embodiment, the rail is heated to a temperature of at least 1900° F. prior to being fed into the first reduction pass.

In an embodiment, the rail initially has a width in a direction from the base portion to the head portion, a height of the head portion perpendicular to the width and a height of the base portion perpendicular to the width being greater than a height of the web portion, and in the first reduction pass the rail is deformed into the bar so as to make the head portion smaller and the base portion smaller than their initial heights.

In an embodiment, in the first reduction pass, as the rail is deformed into the bar, the width of the rail increases.

In an embodiment, in the first reduction pass, as the rail is deformed into the bar, the height of the web portion remains substantially unchanged.

In an embodiment, in the second reduction pass, the bar is maintained at a temperature sufficient to cause the material of the bar to remain in a plastic state.

In an embodiment, in the second reduction pass the bar is further deformed so as to make the former head portion smaller and the former base portion smaller than their heights following the first reduction pass.

In an embodiment, in the second reduction pass, the heights of the former head portion, the former base portion and the web portion are made substantially identical.

In an embodiment, at the exit of the second reduction pass, the bar is slit into two substantially identical bar pieces.

In an embodiment, in the second reduction pass, the bar is maintained at a temperature sufficient to cause the material of the bar to remain in a plastic state.

In an embodiment, at the third reduction pass, the two bar pieces pass through identical shaped rollers to produce substantially identical shaped pieces.

In a variation on the method of recycling the one-piece rail, an additional reduction pass is added before the rail is slit. Thus, in this variation, the steps include: heating the rail to a plastic state; feeding the heated rail through a first reduction pass to reduce a cross section of the rail without slitting the rail; feeding the bar through a second reduction pass in which the cross section of the bar is further modified; feeding the bar through a third reduction pass in which the cross section of the bar is further modified and then slitting the bar along the web portion into two bar pieces, one containing the former head portion and one containing the former base portion, as the bar leaves the third reduction pass; and rolling the two bar pieces through a series of reduction passes to produce a desired final cross section of the pieces.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DETAILED DESCRIPTION OF THE PREFERRED EMBODIMENTS

Figure 1:
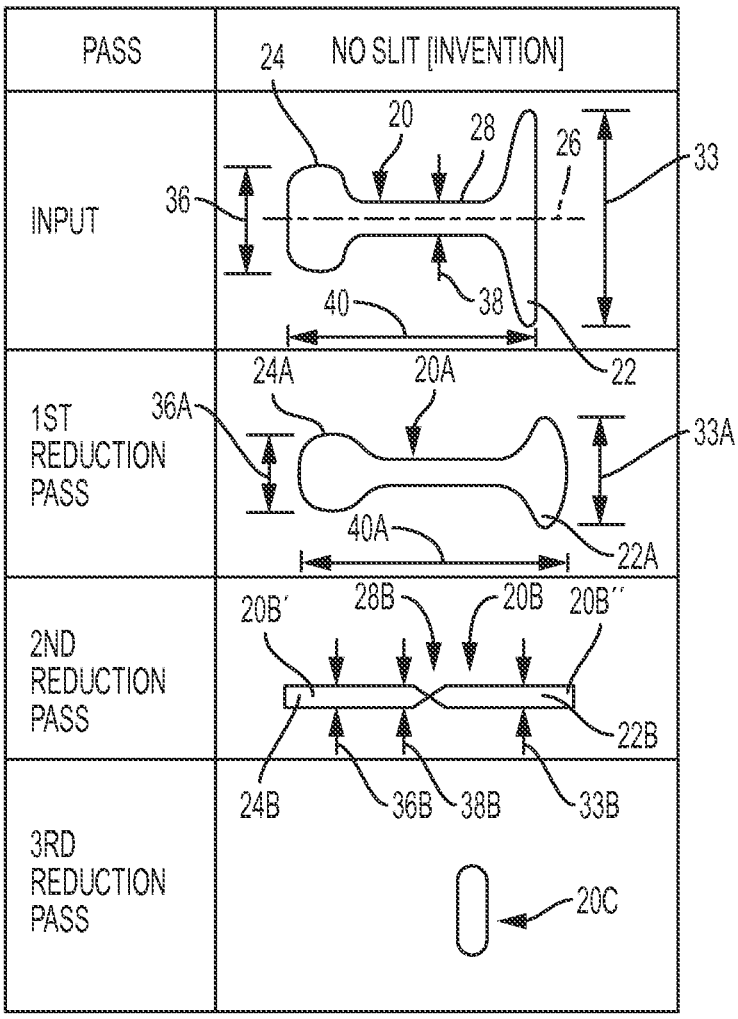
FIG. 1 is a chart showing the cross section of a typical rail at various steps of the present method.
Figure 2:
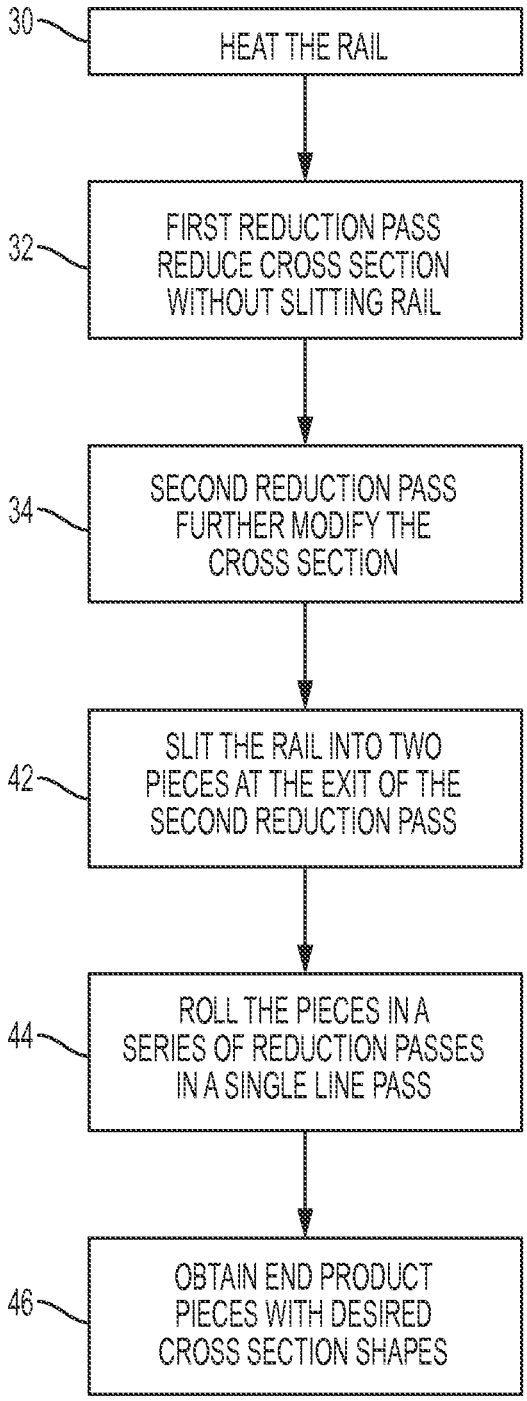
FIG. 2 is a schematic flow chart of steps of a method embodying the present invention.

FIG. 2 illustrates a method of recycling a one-piece elongated rail 20 (see FIGS. 1 and 3) having a base portion 22 and a head portion 24 spaced from each other along an axis 26 by a substantially flat web portion 28, embodying the principles of the present invention in a schematic flow chart form. In step 30 (FIG. 2), the rail 20 is heated to a plastic state. In the case of a typical railroad rail, heating to a temperature of at least 1900° F. is sufficient to place the rail in a plastic state. This is typically accomplished by placing the rail 20 in a furnace and allowing the rail to remain in the furnace for a given period of time, such as 20 to 30 minutes. In this plastic state, the rail 20 may be deformed by passing it through a series of opposed rollers that have surface configurations shaped in a desired surface outline for the rail to become after passing between the rollers. Each set of opposed rollers is referred to as a reduction pass. Such a process is known and is described in some detail in earlier patents such as U.S. Pat. Nos. 4,982,591, 7,073,238 and 7,996,973, the disclosures of which are incorporated herein by reference.

In step 32, the heated rail 20 is fed through a first reduction pass (a first pair of opposed rollers used to change the cross sectional shape of the rail) in a direction of an elongated length of the rail in which a cross sectional shape of the former rail is modified without slitting the rail and which results in a bar 20A (FIG. 1) shaped differently than the rail 20. In a particular embodiment of the process, the rail 20 may be introduced to the first reduction pass in an orientation wherein the rail is rotated about its longitudinal axis by 90° from its normal orientation when in use, so that the head portion 24 and the base portion 22 are arranged generally horizontal relative to one another (in the orientation shown in FIGS. 1 and 3). Guiding mechanisms are provided to hold the rail 20 in this orientation for presentation to the rollers of the first reduction pass. In other embodiments, the rail 20 may be introduced to the first reduction pass in an upright (normal use orientation) position, however the process will be described herein with the rail in the rotated orientation.

Figure 3:
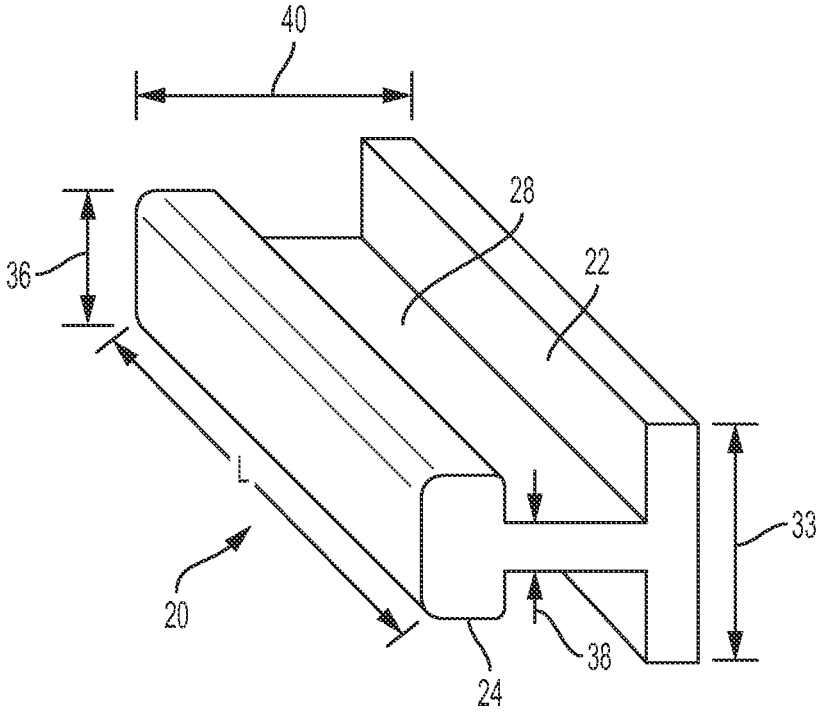
FIG. 3 is a perspective view of a rail that can be used in the initial steps of the method.

Typically initially the base portion 22 has a dimension 33, referred to in this rotated orientation as a height, greater than a corresponding dimension 36, also referred to as a height, of the head portion 24. Both of these heights 33, 36 are initially greater than a height 38 of the web portion 28. Throughout this document the term "height" is meant to mean the dimension that is parallel to a smallest dimension of the web portion 28 of the rail, regardless of the orientation of the rail 20 as it is presented to the first reduction pass. The height dimension extends perpendicular to an elongated length L of the rail 20 (FIG. 3). A width dimension of the rail is meant to be perpendicular to both the height and length and extends in a direction of the spacing of the head portion 24 from the base portion 22 by the web portion 28.

The actual size and shape of the head portion 24 may vary from rail to rail due to differences in the wearing of the bearing surface of the rail and the point at which the rail was removed for recycling. In is in particular this variation of head portion size from rail to rail that renders the present invention more favorable than earlier processes in that the rail is first modified in shape and cross section in the first reduction pass and the second reduction pass before being split so that variations between the two split pieces are minimized. Following the first reduction pass, the cross sectional shape of the former rail is changed sufficiently such that it no longer is considered to be a rail, but instead is now referred to as a bar 20A.

In an embodiment, in the first reduction pass of step 32, the rail 20 is deformed into the bar 20A so as to make a height 36A of a former head portion 24A smaller and a height 33A of a former base portion 22A smaller than their initial heights. In some embodiments, as the heights 33, 36 are decreased in the first reduction pass, the width 40A of the bar 20A from the base portion 22 to the head portion 24 is increased. This increase is referred to as the spread of the material of the rail. Also, in some embodiments, in the first reduction pass of step 32, as the rail 20 is deformed, the height 38 of the web portion 28 remains substantially unchanged.

Another step 34 includes feeding the bar 20A through a second reduction pass in which the cross section of the bar is further modified as shown by bar 20B in FIG. 1. In an embodiment, in the second reduction pass, the bar 20A/20B is maintained at a temperature sufficient to cause the material of the bar to remain in a plastic state. In this second reduction pass, the height 36B of the former head portion 24B, the height 33B of the former base portion 22B and the height 38B of the former web portion 28B may be changed to be approximately equal to each other. In such a step, the heights 33A, 36A of the former base portion 22A and the former head portion 24A may be further decreased.

The method proceeds to step 42 with the slitting of the bar 20B along the web portion 28B into two pieces (20B' and 20B" in FIG. 1), one piece 20B' containing the former head portion 24B and one piece 20B" containing the former base portion 22B, as the bar leaves the second reduction pass. In an embodiment, at the exit of the second reduction pass, the bar 20B is slit into two substantially identical bar pieces.

The method proceeds to step 44 which includes rolling the two pieces 20B' and 20B" of the bar 20B, in a single pass line, through a series of reduction passes to produce (step 46) a desired final cross section 20C of the pieces 20B' and 20B" (as shown in FIG. 1). The orientation of the bar pieces 20B', 20B" may change from reduction pass to reduction pass, such as by rotating the pieces by 90° around the longitudinal axis between various reduction passes. In an embodiment, at a third and subsequent reduction passes, the two bar pieces 20B', 20B" pass through identical shaped rollers, such as the same rollers, to produce substantially identical shaped pieces. When the bar pieces 20B', 20B" actually pass through the same rollers, they do so one at a time, one after the other. To the extent that there are any edge or near edge imperfections on the bar pieces 20B', 20B", such as openings or partial openings, they can be removed, for example with a shearing operation between appropriate reduction passes.

Figure 4:
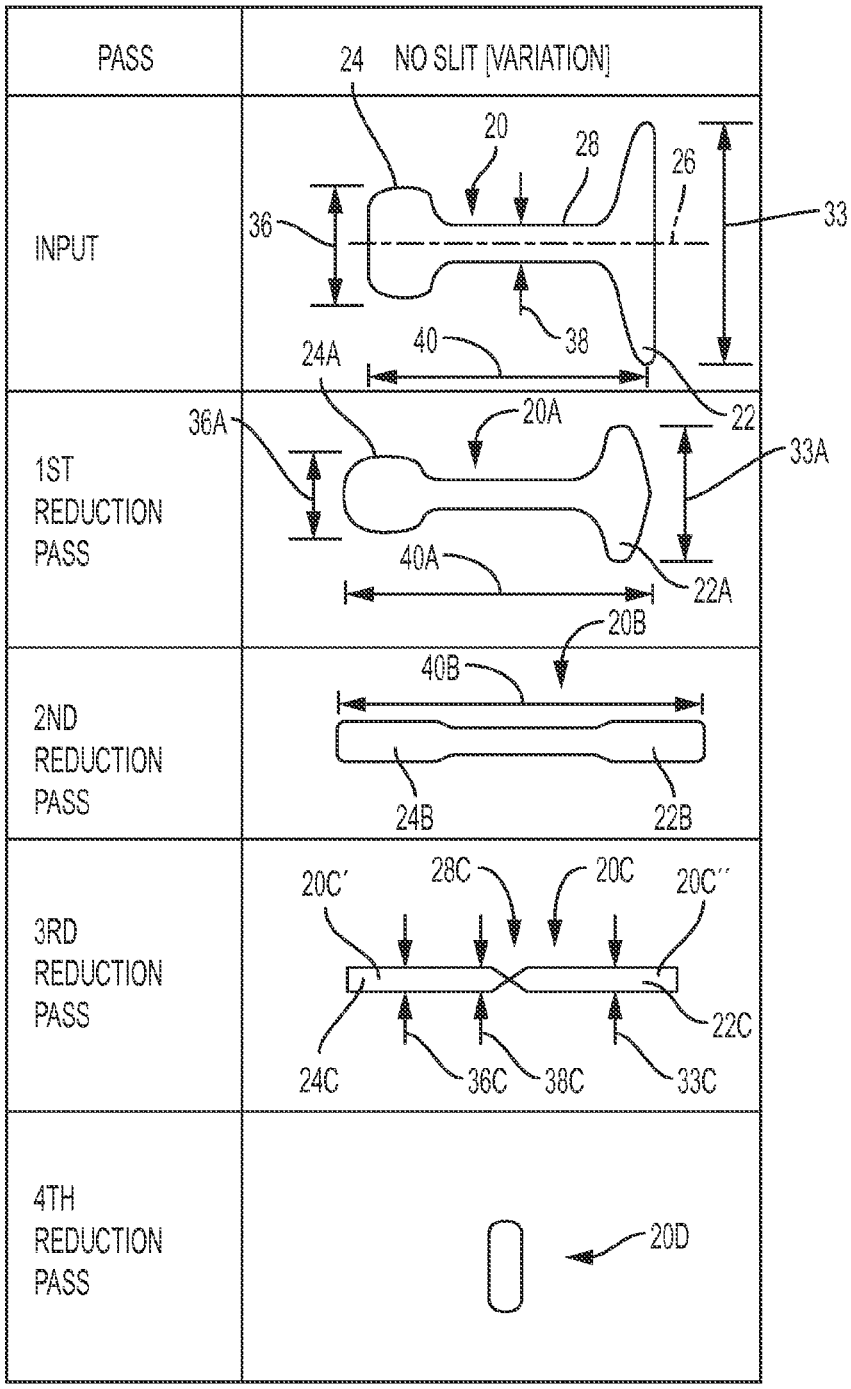
FIG. 4 is a chart showing the cross section of a typical rail at various steps of a variation of the method shown in FIG. 1.
Figure 5:
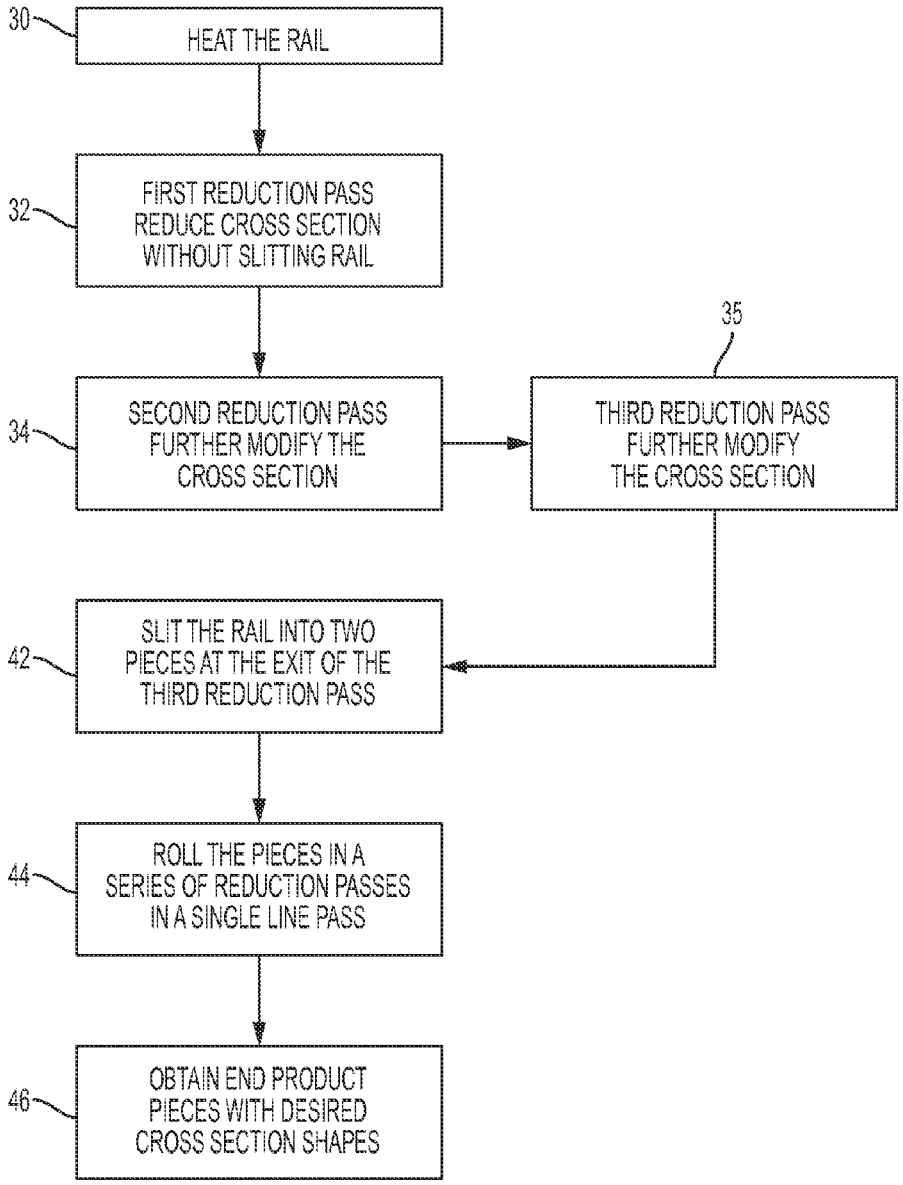
FIG. 5 is a schematic flow chart of steps of a method embodying the variation of FIG. 4.

FIG. 5 illustrates a variation of the method of the flow chart FIG. 2. Essentially, in the FIG. 5 variation, which is associated with the cross-sections of FIG. 4, an additional reduction pass is added prior to the reduction pass in which the bar is slit into two pieces. In other words, in the embodiment of FIG. 2

(which is associated with the cross-sections of FIG. 1), the bar is slit at the exit of the second reduction pass, while in the embodiment of FIG. 5 (which is associated with the cross-sections of FIG. 4), the bar is slit at the exit of the third reduction pass, as explained in more detail below. One of the benefits of the method of FIG. 5 is that the additional reduction pass provides additional deformation of the bar prior to reaching the slitting reduction pass. Accordingly, there is less "work" required of the slitting reduction pass to transform the bar from the cross-section at its input region into the cross section at its output region. When a reduction pass is performing less "work," the motor associated therewith is able to draw less current.

Following is a detailed description of the method of FIG. 5 (associated with FIG. 4). In this method, a one-piece elongated rail 20 (see FIG. 4), which is essentially the same as that described above with respect to the FIG. 2 method, is provided. In this embodiment, features similar to those in the embodiment of FIGS. 1 and 2 have been given the same reference numbers as in FIGS. 1 and 2, and a detailed description of such features need not be repeated.

In step 30 (FIG. 5), the rail 20 is heated to a plastic state in the same manner as in the earlier embodiment. In step 32, the heated rail 20 is fed through a first reduction pass in a direction of an elongated length of the rail in which a cross sectional shape of the former rail is modified without slitting the rail and which results in a bar 20A (FIG. 4), which is shaped differently than the rail 20. In a particular embodiment of the process, the rail 20 may be introduced to the first reduction pass in an orientation wherein the rail is rotated about its longitudinal axis by 90° from its normal orientation when in use, so that the head portion 24 and the base portion 22 are arranged generally horizontal relative to one another (in the orientation shown in FIG. 4). As in other embodiments, guiding mechanisms are provided to hold the rail 20 in this orientation for presentation to the rollers of the first reduction pass. In alternative embodiments, the rail 20 may be introduced to the first reduction pass in an upright (normal use orientation) position, however the process will be described herein with the rail in the rotated orientation.

Typically initially the base portion 22 has a dimension 33, referred to in this rotated orientation as a height, greater than a corresponding dimension 36, also referred to as a height, of the head portion 24. Both of these heights 33, 36 are initially greater than a height 38 of the web portion 28. As mentioned earlier, throughout this document the term "height" is meant to mean the dimension that is parallel to a smallest dimension of the web portion 28 of the rail, regardless of the orientation of the rail 20 as it is presented to the first reduction pass. The height dimension extends perpendicular to an elongated length L of the rail 20 (FIG. 3). A width dimension of the rail is meant to be perpendicular to both the height and length and extends in a direction of the spacing of the head portion 24 from the base portion 22 by the web portion 28.

As with the earlier embodiments, the actual size and shape of the head portion 24 may vary from rail to rail due to differences in the wearing of the bearing surface of the rail and the point at which the rail was removed for recycling. In is in particular this variation of head portion size from rail to rail that renders the present invention more favorable than earlier processes in that the rail is first modified in shape and cross section in the first, second and third reduction passes before being split so that variations between the two split pieces are minimized. Following the first reduction pass, the cross sectional shape of the former rail is changed sufficiently such that it no longer is considered to be a rail, but instead is now referred to as a bar 20A.

In an embodiment, in the first reduction pass of step 32, the rail 20 is deformed into the bar 20A so as to make a height 36A of a former head portion 24A smaller and a height 33A of a former base portion 22A smaller than their initial heights. In some embodiments, as the heights 33, 36 are decreased in the first reduction pass, the width 40A of the bar 20A from the base portion 22 to the head portion 24 is increased. Also, in some embodiments, in the first reduction pass of step 32, as the rail 20 is deformed, the height 38 of the web portion 28 remains substantially unchanged.

In step 34, which is the second reduction pass, the bar 20A is deformed into bar 20B (FIG. 4). In certain embodiments, bar 20B will be symmetric in both the width and height directions, although in other embodiments the former base portion 22B may not be symmetric with the former head portion 24B. As can be seen in FIG. 4, the heights of the former head portion 24B and the former base portion 22B have been decreased, as compared with the portions 24A and 22A, respectively, of the first reduction pass. Also, in certain embodiments, the width 40B of the bar 20B is increased, as compared with the width 40A of the bar 20A of the previous step.

Step 35 includes feeding the bar 20B through a third reduction pass in which the cross section of the bar is further modified as shown by bar 20C in FIG. 4. In an embodiment, in the third reduction pass, the bar 20A/20B/20C is maintained at a temperature sufficient to cause the material of the bar to remain in a plastic state. In this third reduction pass, the height 36C of the former head portion 24C, the height 33C of the former base portion 22C and the height 38C of the former web portion 28C may be changed to be approximately equal to each other. In such a step, the heights 33C, 36C of the former base portion 22C and the former head portion 24C may be further decreased.

The method proceeds to step 42 with the slitting of the bar 20C along the web portion 28C into two pieces (20C' and 20C" in FIG. 1), one piece 20C' containing the former head portion 24C and one piece 20C" containing the former base portion 22C, as the bar leaves the third reduction pass. In an embodiment, at the exit of the third reduction pass, the bar 20C is slit into two substantially identical bar pieces.

The method proceeds to step 44 which includes rolling the two pieces 20C' and 20C" of the bar 20C, in a single pass line, through a series of reduction passes to produce (step 46) a desired final cross section 20D of the pieces 20C' and 20C" (as shown in FIG. 4). The orientation of the bar pieces 20C', 20C" may change from reduction pass to reduction pass, such as by rotating the pieces by 90° around the longitudinal axis between various reduction passes. In an embodiment, at a fourth and subsequent reduction passes, the two bar pieces 20C', 20C" pass through identical shaped rollers, such as the same rollers, to produce substantially identical shaped pieces. When the bar pieces 20C', 20C" actually pass through the same rollers, they do so one at a time, one after the other. To the extent that there are any edge or near edge imperfections on the bar pieces 20C', 20C", such as openings or partial openings, they can be removed, for example with a shearing operation between appropriate reduction passes.

One of the additional advantages of the present invention involves savings related to the entry and delivery guiding systems, as compared with other methods in which the bar is slit into two pieces that are not substantially identical in shape, as explained below.

By way of background, each reduction pass in a rolling mill has a guiding system, namely an entry guiding system (EGS) that guides the rail into the reduction pass (i.e., at the entry of the reduction pass), and delivery guiding system (DGS), that delivers the rail from the reduction pass (i.e., at the exit of the reduction pass). As known in the art, the EGS includes various guiding components, such as entry guides and guide boxes, for guiding rail into the reduction pass, and the DGS includes various delivery components, such as delivery guides and guide boxes, to extract the rail from the reduction pass.

Figure 6:
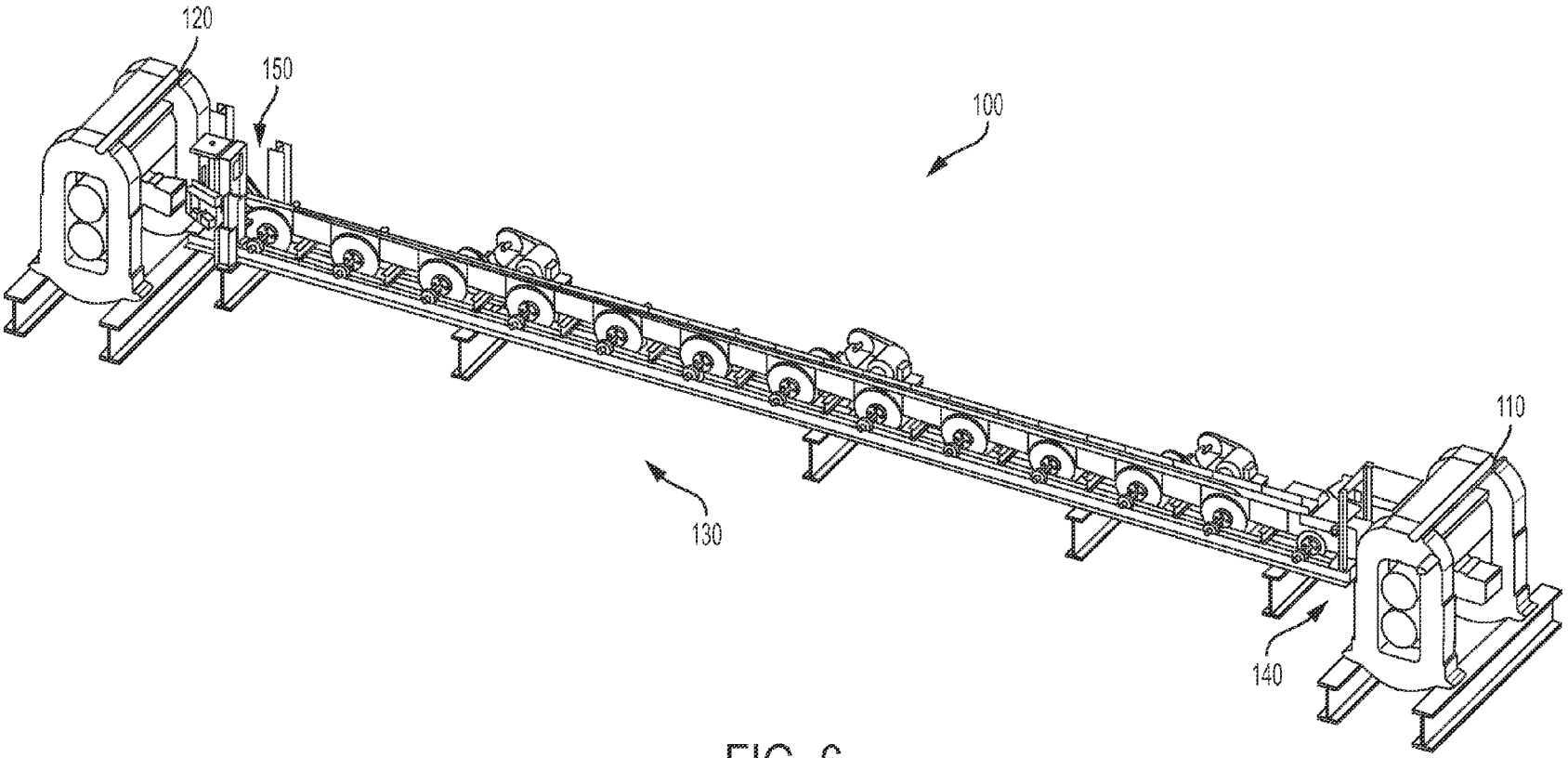
FIG. 6 shows a schematic of a portion of a rail line including a slitting reduction pass and an additional reduction pass down the line from the slitting reduction pass.

FIG. 6 shows a schematic of a portion of a rail line 100 including a slitting reduction pass 110 (such as corresponding to the second reduction pass of FIG. 1 or corresponding to the third reduction pass of FIG. 4) and an additional reduction pass 120 down the line from the slitting reduction pass 110, with various components of a conveyor line 130, such as motors and rotating members, provided between reduction passes 110 and 120, as known in the art. The additional reduction pass 120 can be considered as corresponding to the third reduction pass of FIG. 1 or as corresponding to the fourth reduction pass of FIG. 4. FIG. 6 also shows DGS 140 at the exit of slitting reduction pass 110, and EGS 150 at the entrance of reduction pass 120. Although not shown, each reduction pass in the line will include both a DGS and a EGS.

In certain embodiments of the present invention, after the bar is slit in slitting reduction pass 110 into two pieces that are substantially identical in shape (such as pieces 20B' and 20B" of FIG. 1, or pieces 20C' and 20C" of FIG. 4), the two pieces (20B'/20B or 20C'/20C") are presented to the next reduction pass 120 one after another. In certain embodiments, this alternate feed process uses a conveyor after the slitting pass, which has two gates at its exit end. Each of these gates is a steel plate that has a pneumatic cylinder attached to it. The steel plates act as a barrier preventing the exit of the bars from the conveyor until either of the gates is manually opened using an electrical signal to activate the pneumatic cylinder. While one bar is conveyed to the next reduction pass, the other bar stays on the conveyor. After the first bar completely passes, the second gate is opened to allow exit of the second bar, which then enters the next reduction pass.

Since, in preferred embodiments of the present method, both of the pieces (20B'/20B or 20C'/20C") of the pair are substantially identical, there is need of only one such EGS and one DGS for each reduction pass. In preferred embodiments of this invention, this holds true for all reduction passes subsequent to the slitting reduction pass until the finished product is rolled out. For example, in one preferred embodiment, a T-post shape could be rolled using nine subsequent reduction passes after the slitting pass, and in each of these nine reduction passes only a single EGS and a single DGS is used. In contrast, in a method such as that disclosed in U.S. Pat. No. 7,996,973 to Moore et al., two EGSs and two DGSs will be required for each reduction pass after the slitting reduction pass. This is the case because the shapes shown in the Moore et al. patent after the slit are not substantially identical (compare FIG. 5*a* with FIG. 5*b* of Moore et al., and compare FIG. 6*a* with FIG. 6*b* of Moore et al.). These two pieces of Moore et al. cannot be introduced into same EGS or the same DGS, but instead they need to use separate EGSs and separate DGSs. Producing and maintaining two sets of EGSs of different configurations and two sets of DGSs of different configurations is more costly than only using a single set of EGSs and DGSs, as in preferred embodiments of the present method.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A method of recycling a one-piece rail having a base portion and a head portion spaced from each other along an axis by a substantially flat web portion, said method comprising:

heating the material of the rail to a plastic state, feeding the heated rail through a first reduction pass to form a bar having a former head portion, a web portion and a former base portion in which a starting cross section of the rail is reduced in at least one dimension without slitting the rail or the bar, feeding the bar through a second reduction pass in which the cross section of the bar is further modified, feeding the bar through a third reduction pass in which the cross section of the bar is further modified such that the height of the former head portion, the height of the former base portion, and the height of the web portion are substantially equal to each other, slitting the bar along the web portion into two substantially identical pieces, one piece containing the head portion and one piece containing the base portion, as the bar leaves the third reduction pass, rolling the two pieces of the bar through a series of reduction passes to produce a desired final cross section of the bar pieces, whereby both bars are passed through identical shaped rollers to produce substantially identical shaped bar pieces.

2. The method according to claim 1, wherein the rail is heated to a temperature to cause the material of the rail to be in a plastic state prior to being fed into the first reduction pass.

3. The method according to claim 1, wherein the rail initially has a width in a direction from the base portion to the head portion, a height of the head portion perpendicular to the width and a height of the base portion perpendicular to the width being greater than a height of the web portion, and in the first reduction pass the rail is deformed so as to make the height of the head portion smaller and the height of the base portion smaller than their initial heights.

4. The method according to claim 3, wherein in the first reduction pass, as the rail is deformed into the bar, the width of the rail increases.

5. The method according to claim 3, wherein in the first reduction pass, as the rail is deformed into the bar, the height of the web portion remains substantially unchanged.

6. The method according to claim 1, wherein in the second reduction pass, the bar is maintained at a temperature sufficient to cause the material of the bar to remain in a plastic state.

7. The method according to claim 3, wherein in the second reduction pass the bar is further deformed so as to make the former head portion smaller and the former base portion smaller than their heights following the first reduction pass.

8. The method according to claim 3, wherein in the second reduction pass, the heights of the former head portion, the former base portion and the web portion are made substantially identical.

9. The method according to claim 3, wherein at the exit of the third reduction pass, the bar is slit into two substantially identical bar pieces.

10. The method according to claim 1, wherein in the third reduction pass, the bar is maintained at a temperature sufficient to cause the material of the bar to remain in a plastic state.

11. The method according to claim 9, wherein subsequent to the third reduction pass, the two bar pieces pass through a further reduction pass with identical shaped rollers to produce substantially identical shaped bar pieces.

12. A method of recycling a one-piece elongated rail having a base portion and a head portion spaced from each other by a web portion, the rail having a length in a direction of elongation of the rail, a width perpendicular to the length in a direction of the spacing of the head portion from the base portion by the web portion, and a height of each of the head portion, the base portion and the web portion in a direction perpendicular to both the length and the width, the method comprising the steps:

heating the rail to a plastic state, feeding the heated rail in a direction of the length through a first reduction pass to form a bar having a former head portion, a web and a former base portion in which the height of the head portion and the height of the base portion are reduced without slitting the rail or the bar, feeding the bar through a second reduction pass in which the height of the former head portion and the height of the former base portion are reduced, feeding the bar through a third reduction pass in which the height of the former head portion and the height of the former base portion are further reduced such that the height of the former head portion, the height of the former base portion, and the height of the web portion are substantially equal to each other, slitting the bar along the web portion into two substantially identical pieces, one piece containing the former head portion and one piece containing the former base portion, as the bar leaves the third reduction pass, rolling the two pieces of the bar through a series of reduction passes to produce a desired final cross section of the pieces, whereby both bars are passed through identical shaped rollers to produce substantially identical shaped bar pieces.

13. The method according to claim 12, wherein in the first reduction pass, as the rail is deformed into the bar, the height of the web portion remains substantially unchanged.

14. The method according to claim 12, wherein in the second reduction pass the bar is further deformed so as to make the former head portion smaller and the former base portion smaller than their heights following the first reduction pass.

15. The method according to claim 12, wherein in the third reduction pass, the heights of the former head portion, the former base portion and the web portion are made substantially identical.

16. The method according to claim 1, wherein during said step of rolling the two pieces of the bar through said series of reduction passes, the two pieces of the bar both pass through the same reduction passes, with one of the two pieces of the bar passing through each pass before the other of the two pieces of the bar.

17. The method according to claim 12, wherein during said step of rolling the two pieces of the bar through said series of reduction passes, the two pieces of the bar both pass through the same reduction passes, with one of the two pieces of the bar passing through each pass before the other of the two pieces of the bar.

18. The method according to claim 1, whereby during said step of rolling the two pieces of the bar through a series of reduction passes, both pieces are passed through a single entry guiding system associated with each reduction pass of the series, and a single delivery guiding system is associated with each reduction pass of the series.

19. The method according to claim 18, wherein during said step of rolling the two pieces of the bar through said series of reduction passes, the two pieces of the bar both pass through the same reduction passes, with one of the two pieces of the bar passing through each pass before the other of the two pieces of the bar.

* * * * *